United States Patent [19]

Wells, Jr.

[11] 4,135,080

[45] Jan. 16, 1979

[54] PORTABLE ELECTRIC HEAT GUN

[75] Inventor: Peter M. Wells, Jr., Sycamore, Ill.

[73] Assignee: Ideal Industries, Inc., Sycamore, Ill.

[21] Appl. No.: 726,989

[22] Filed: Sep. 27, 1976

[51] Int. Cl.[2] ..... H05B 3/02; F24H 3/04; A45D 20/10

[52] U.S. Cl. ..... 219/370; 34/97; 34/243 R; 219/364; 219/373

[58] Field of Search ..... 219/370, 369, 373–376, 219/379–382, 364, 365, 366–368; 34/243 R, 96–101

[56] References Cited

U.S. PATENT DOCUMENTS

| | | | |
|---|---|---|---|
| 1,564,896 | 12/1925 | Rimker et al. | 219/370 |
| 1,821,525 | 9/1931 | Nielsen | 219/370 |
| 2,041,687 | 5/1936 | Benson | 219/370 |
| 2,764,667 | 9/1956 | Joriman et al. | 219/374 X |
| 2,834,866 | 5/1958 | Bentzman | 219/370 X |
| 3,211,890 | 10/1965 | Graves | 219/370 |
| 3,668,370 | 6/1972 | Pattison | 219/370 X |

FOREIGN PATENT DOCUMENTS

| | | | |
|---|---|---|---|
| 761583 | 11/1956 | United Kingdom | 219/370 |
| 972682 | 10/1964 | United Kingdom | 219/370 |

*Primary Examiner*—A. Bartis

*Attorney, Agent, or Firm*—Kinzer, Plyer, Dorn & McEachran

[57] ABSTRACT

An electric heat gun which is intended for use on a production line or the like is molded in three parts with a squirrel cage type fan and motor inside the housing and an electric air heating nozzle projecting from the front thereof. The fan and motor are mounted on a horizontal plate. The cylindrical nozzle is mounted in a position generally tangential to the fan and receives air therefrom through an adapter which gradually changes the outline of the air flow path from a square cross section at the fan outlet to the round cross section at the nozzle.

14 Claims, 5 Drawing Figures

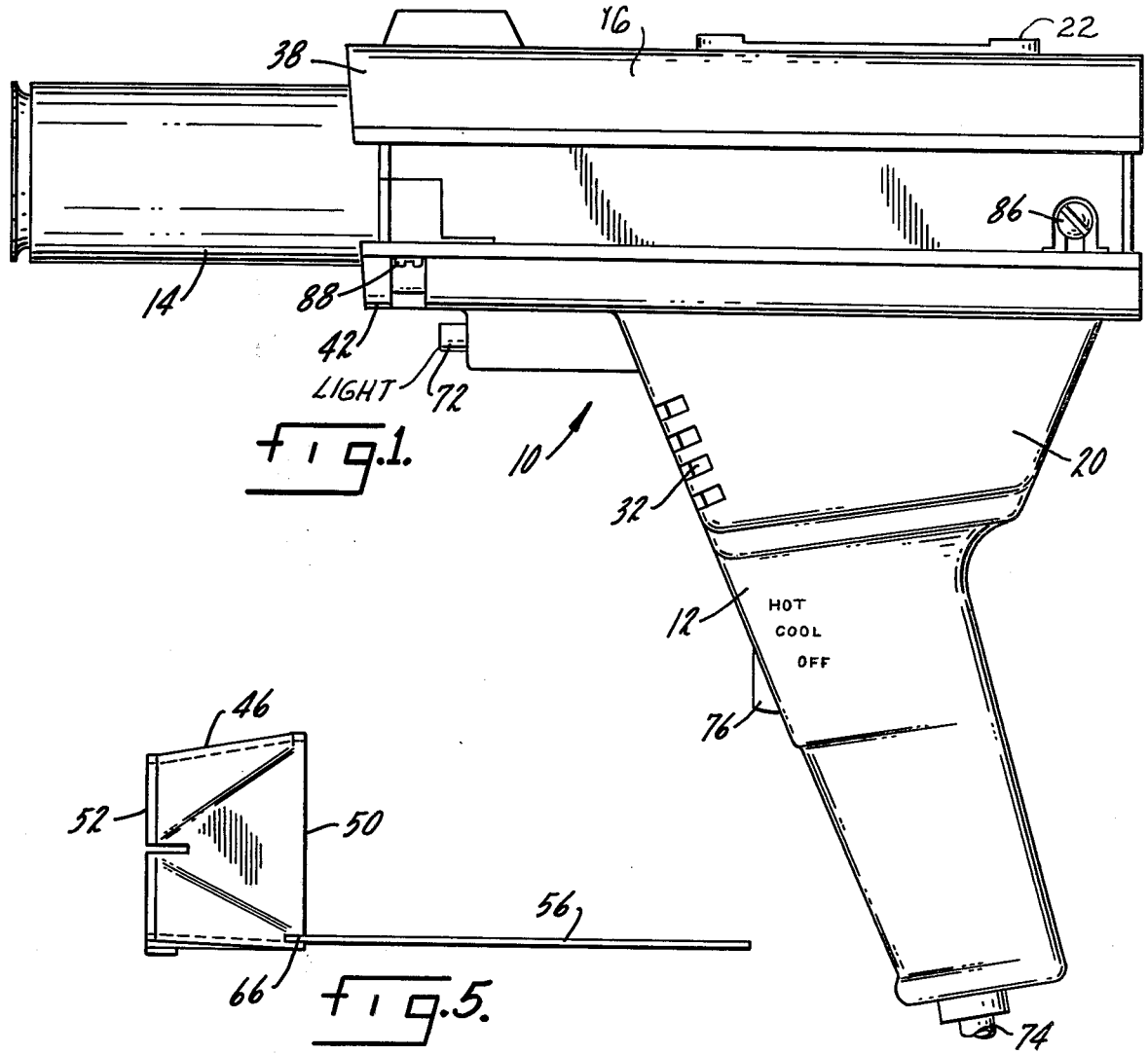
fig.1.
fig.5.
fig.2.
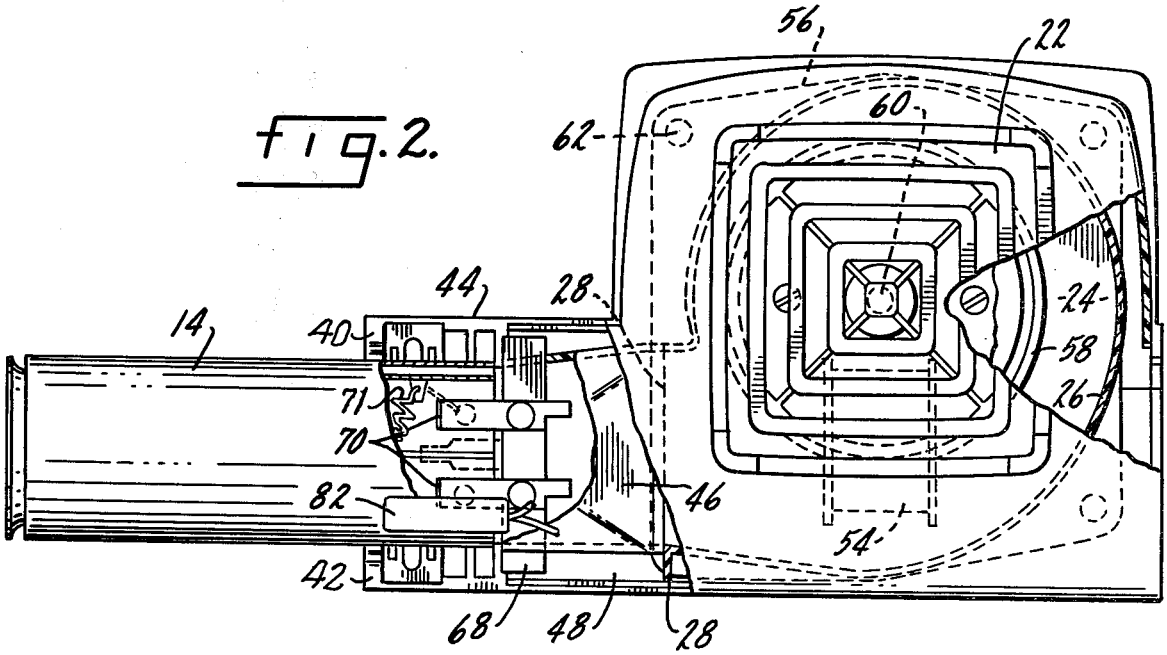

PORTABLE ELECTRIC HEAT GUN

SUMMARY OF THE INVENTION

This is concerned with an electric heat gun and is more specifically concerned with a simplified, easy-to-manufacture-and assemble unit, to be operated and used by hand on an assembly line or the like.

The heat gun has a housing which encloses a fan and fan motor. Extending from the lower surface of the housing is a handle and an electric air heating nozzle projects from the front of the housing. The nozzle receives air from the fan by way of an adapter which gradually changes the shape of the air flow path from a square cross section at the fan outlet to the round cross section of the nozzle. The fan and its motor are mounted on a generally horizontally disposed plate. Access to the inside of the housing is provided by dividing the housing into sections which can be fastened together. The fan mounting plate is trapped between and held by sections of the housing. An opening is provided in the top of the housing for admitting air to the fan and there is a circuit provided for operating the fan and electric air heating nozzle.

A primary object of the invention is an electric heat gun with a greatly improved efficiency in air flow.

Another object is an internal structure for a heat gun of the above type which greatly facilitates assembly.

Another object is a housing structure for an electric heat gun which is simple to mold and inexpensive to assemble.

Other objects will appear from time to time in the ensuing specification and drawings.

BRIEF DESCRIPTION OF THE DRAWINGS

FIG. 1 is a side view of the electric heat gun;

FIG. 2 is a top view of FIG. 1, partly in section;

FIG. 5 is a side view of a detail.

DESCRIPTION OF THE PREFERRED EMBODIMENT

Figures 3, 4:
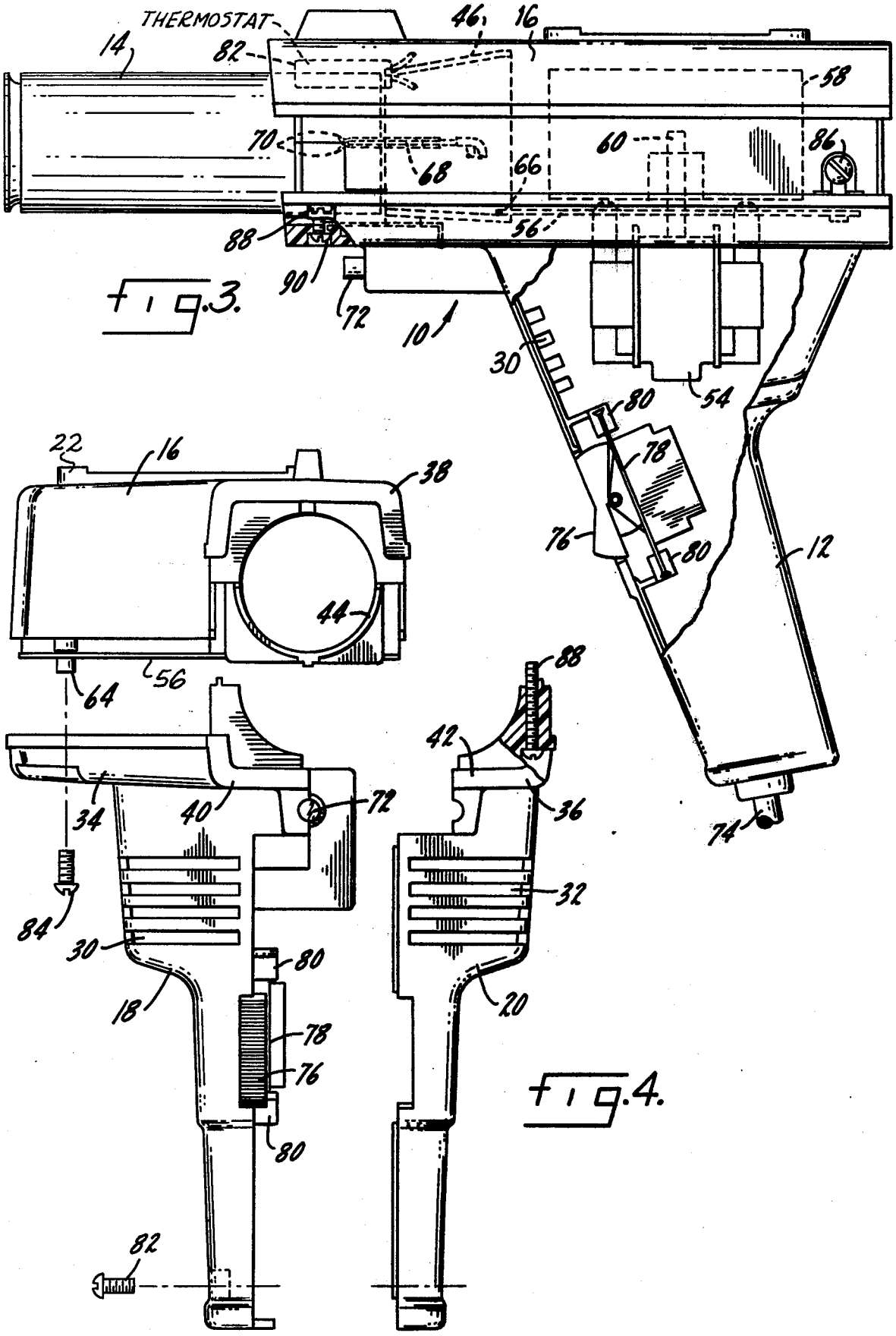
FIG. 3 is a side view, similar to FIG. 1, with parts in section.
FIG. 4 is a front view with parts exploded.

The electric heat gun includes a housing indicated generally at 10 which has a handle 12 of the pistol-grip type depending from the lower surface and a electric air heating nozzle 14 projecting from the front. As shown in FIG. 4, the housing is made up of three main parts, a top cover 16 and two side-by-side housing halves 18 and 20.

The top cover has a grill-like air intake 22 in the upper surface thereof which admits air to a squirrel cage or scroll chamber 24 defined by an inner, somewhat spiral wall 26 formed or molded as an integral part up inside of the top cover terminating at the free edge 28.

The left housing half 18 in FIG. 4 has cooling vents or slots 30 in the forward face thereof, as does the right housing half 20, as at 32. The left housing half merges upwardly into and is integral with an outstanding flange or overhang 34 which, together with a somewhat smaller or similar overhang or flange 36 on the right housing half, forms an upper platform when the two are brought together on to which the top cover 16 is seated and connected.

The top cover 16 has a forward, semicylindrical projection 38 which is aligned with the forward or free edge 28 of the scroll with the two housing halves having corresponding forward projections 40 and 42 which, when they are brought together, match the overhang 38 on the top cover to provide a forwardly projecting socket for the electric air heating nozzle 14.

It will be noted that the cross section of the outlet of the scroll, when taken on a radius, presents a somewhat square appearance, whereas the opening through the forward socket 44, that holds the electric air heating nozzle, is round. To provide for a smooth transition in the air flow, an insert 46 in the form of a separate piece, is positioned in a cavity 48 in the socket, with the insert being somewhat tubular and changing gradually from a generally square cross section 50 at its rear edge to a generally round cross section 52 at its front edge. When positioned in the cavity 48, the insert will be tightly held by the three housing parts and in a sense will be trapped, although not otherwise connected to any one of the three housing parts.

As a separate insert, a fan motor 54 is mounted on the bottom of a plate 56, by screws of the like, with its shaft extending upwardly through a suitable opening in the plate with a fan or rotor 58 on the upper end of the shaft inside of the scroll chamber 24. It will be noted in FIG. 2 that the fan and fan motor are positioned about a generally vertically disposed shaft 60 which is centrally located relative to the scroll and inlet grill with the scroll or inner wall 26 developing spirally around it so that air from the squirrel cage rotor or fan 58 will move clockwise in FIG. 2 outwardly and off tangentially through the insert or adapter 46 to the electric air heating nozzle 14. The plate 56 has suitable openings 62 which register with pins 64 projecting down from the top cover 16 so that the plate along with the fan and fan motor will be held between the top cover on the one hand and the lower housing halves on the other. The plate also fits down into the outstanding flanges 34 and 36 on the two housing halves in a kind of countersunk relation so that when the two housing halves are brought together, the plate will be more or less held or trapped between them.

The forward edge of the plate fits into notches 66 in the rear edge of the insert or adapter 46 which, first, holds the plate in place, second, holds the adapter or insert in place in the cavity 48 and, third, registers the plate adapter or insert as a unit with the three main housing parts.

A mounting bar arrangement 68 is disposed horizontally across the air flow passage ahead of the adapter with a pair of electrical connectors 70 extending forwardly therefrom to accept contacts in the rear of the electric air heating nozzle, it being understood that the nozzle itself contains a plurality of resistance heating elements 71 with, possibly, a protective screen across the front. But these details are old and well known in and of themselves and will not be further explained in detail.

The details of the circuit are also of no importance but may include a light 72 held between the two housing halves, a cord 74 entering the bottom of the handle in a conventional manner for connection to a source of current, and a switch 76 mounted in a forward part of the handle. All of these may be interconnected along with the fan motor 54 in a conventional manner to provide current to the heating elements in the electric air heating nozzle and the fan motor in any desired manner.

The switch 76 itself may be a separate insert with ears 78 projecting from each end that fit into sockets 80 in FIG. 3 molded into one of the housing halves, for example the left housing half 18 in FIG. 4. The advantage of this is that during assembly the switch can be mounted in one of the two halves and does not require that the other half have corresponding sockets to fit half of the ears 78. In the arrangement shown, the ears 80 and switch will be mounted in the left half and will project into the right half when the two halves are brought together, as shown in FIG. 4.

In FIGS. 2 and 3 a thermostat 82 has been shown mounted in the forward socket 44 on the outside of the electric air heating nozzle 14 and preferably bearing against its surface. The thermostat is wired into the circuit in a manner, not shown, so that when the temperature on the outside of the electric air heating nozzle 14 reaches a certain point, the thermostat will turn off the heaters, but the fan will continue to operate so that the electric air heating nozzle 14 will cool down to a predetermined temperature. The thermostat or thermoprotector element has the advantage that the protector case or tubing around the electric air heating nozzle is hot and therefore it is insulated by a thin wall tubing. The tubing must be thin enough such that the response time to temperature change occurs before the plastic of the housing exceeds its maximum rated temperature. It may well occur on occasion that the heating element in the electric air heating nozzle 14 will over heat due to, for example, the outlet being or becoming blocked or restricted, the air inlet being blocked or restricted, the impeller not rotating, the motor malfunctioning, etc. Thus the thermostat will sense when the exterior of the electric air heating nozzle 14 has reached a temperature such that it may well damage the plastic of the housing. The thermostat will turn off the heater elements until it cools down to a safe point. Absent such a feature might require that the housing be made of a much more expensive plastic which would not be damaged due to excess heating of the electric air heating nozzle due to one of the malfunctions set forth above. The precise location of the thermostat or thermoprotector is not critical, although the location shown is very desirable. Suffice it to say that it could be in another location, or any area where an excessive temperature of the electric air heating nozzle would be picked up rather quickly.

The use, operation and function of the invention are as follows:

This is a new and novel electric heat gun which is adapted to be used in manufacturing processes for projecting a relatively high temperature air wherever it is needed on an assembly line, for example shrinking plastic, low temperature heating of metal parts, etc. The unit is somewhat larger and provides a greater volume of air at a slightly higher temperature than previous units and is constructed to be easily handled on an assembly line or elsewhere and may be operated in almost any position.

Several of the advantages or features of the present invention are that the unit is hand-held and can be used by unskilled labor. At the same time it can be set down and operated while lying on either side or upside-down, as well as pointed up in the air.

The fan itself is enclosed within a scroll, which is conventional and efficient practice for fans, with the outlet or nozzle tangential to one side thereof, as shown in FIG. 2, so that the most efficient air flow through the electric air heating nozzle is acquired. At the same time, the cross section of the scroll is square, while the nozzle itself is round. So the air flow goes through an adapter or insert which changes gradually from a square to a round cross section.

The housing itself is molded in three main parts, two side-by-side handle halves which are brought together with a cover that fits down on the two. The top cover itself has the scroll molded into it with the insert or adapter being fitted or socketed basically into the top cover.

The fan and motor are mounted on a separate, somewhat flat, square plate which is doubly trapped in the three main housing parts. It is trapped first between the two handle halves when they are brought together and, second, between the handle and the top cover, with the plate having openings that register with pins or projections on either the cover or the handle.

The three main parts, as well as the insert or adapter, may all be molded of plastic and may be held together, when assembled, by screws, such as at 82 which holds the bottom of the two handle halves together, 84 which connect the left handle half to the top cover, 86 which connects the right handle half to the top cover, 88 which holds or joins the two platform projections 40 and 42 on the handle halves to the overhang 38 on the top cover, and 90 which releasably holds the electric air heating nozzle in the front of the housing.

The switch mounting is of particular advantage since it does not require registry between the two housing halves with or coordinated to the switch, but rather the switch is first mounted in one half and the other merely fitted over it.

While the preferred form and several variations of the invention have been shown and suggested, it should be understood that suitable additional modifications, changes, substitutions and alterations may be made without departing from the invention's fundamental theme.

The embodiments of the invention in which an exclusive property or privilege is claimed are defined as follows:

1. In an electric heat gun assembly, a housing with a handle depending from the lower surface thereof and an electric air heating nozzle projecting from the front, a fan and fan motor in the housing for directing an air stream out through the nozzle, an opening in the top of the housing for admitting air to the fan, the fan and fan motor being mounted on a generally horizontally disposed plate, the housing including two vertically disposed side-by-side halves fastened together, the plate being trapped between and held by the two housing halves, and a circuit in the housing for controlling operation of the fan and electric air heating nozzle.

2. The structure of claim 1 further characterized by and including a plurality of electric heat elements in the electric air heating nozzle.

3. The structure of claim 1 further characterized in that the housing is formed in three main parts, the two side-by-side housing halves and a top cover that fits down on and is connected to the side-by-side housing halves.

4. The structure of claim 1 further characterized in that the inside of the housing is formed into a scroll defined about a generally vertically disposed axis with the fan disposed therein, and the electric air heating nozzle is disposed generally tangent to the scroll so that it is offset relative to the vertically disposed axis.

5. In an electric heat gun assembly, a housing with a handle depending from the lower surface thereof and an electric air heating nozzle projecting from the front thereof, the fan and fan motor in the housing for directing an air stream out through the nozzle, the housing being divided into three main parts, two of the parts being vertically disposed side-by-side halves fastened together, and the third part being a top cover that fits down on and is connected to the side-by-side housing halves, an opening in the top cover of the housing for admitting air to the fan, and a circuit in the housing for controlling operation of the fan and electric air heating nozzle, with the fan and fan motor mounted on a generally horizontally disposed plate trapped between and held by the top cover and the two housing halves.

6. The structure of claim 5 further characterized by and including an adaptor in the air flow path between the fan and nozzle formed as a separate piece and held in place by the three main parts of the housing, the adaptor defining a transition element in the air flow path which gradually changes the space in which the air flows from a square cross section adjacent to the fan to a round cross section adjacent said nozzle.

7. The structure of claim 5 further characterized by and including an adaptor in the air flow path between the fan and the nozzle formed as a separate piece and held in place by the three main parts of the housing, the forward edge of the horizontally disposed plate socketing into the rear edge of the adaptor, the adaptor defining a transition element in the air flow path which gradually changes the space in which the air flows from a square cross section adjacent to the fan to a round cross section adjacent said nozzle.

8. The structure of claim 5 further characterized by and including a scroll formed inside of the housing in the top cover thereof, the fan being disposed in the scroll, and the electric air heating nozzle is disposed generally tangential to the scroll so that it is offset relative to the vertically disposed axis of the fan.

9. The structure of claim 8 further characterized in that the fan and fan motor are mounted with the fan in the top cover above the plate and the fan motor below the plate between the two side-by-side housing halves.

10. The structure of claim 5 further characterized in that the electric air heating nozzle is a separate element held between the three main parts of the housing.

11. In an electric heat gun assembly, a housing with a handle depending from the lower surface thereof, a fan and fan motor in the housing for directing an air stream outwardly from the housing, an opening in the top of the housing for admitting air to the fan, a circuit in the housing for operating the fan and fan motor, the inside of the housing being formed into a scroll defined about a generally vertically disposed axis, a generally cylindrical electric air heating nozzle projecting from the front of the housing which receives air from the scroll, and an adapter between the scroll and nozzle defining an air flow path which gradually changes from a square cross section adjacent the scroll outlet to a round cross section adjacent the inlet end of the nozzle.

12. The structure of claim 11 further characterized in that the housing is defined by three main parts, two of the parts being vertically disposed side-by-side halves fastened together, and the third part being a top cover that fits down on and is connected to the side-by-side housing halves, and further characterized in that the adapter is a separate part and is held between the three main housing parts.

13. The structure of claim 11 further characterized in that the heat nozzle is disposed generally tangent to the scroll and is offset relative to the vertically disposed axis so that it projects from the front of the housing in an offset position.

14. The structure of claim 11 further characterized in that the fan and fan motor are mounted on a generally horizontally disposed plate, the housing being divided into three main parts, two of which are vertically disposed side-by-side halves fastened together, and the third is a top cover that fits down on and is connected to the side-by-side housing halves, the horizontally disposed plate being held between the top cover and the two housing halves with the fan above the plate in the top cover and the fan motor below the plate between the two housing halves.

* * * * *